US010724815B2

(12) United States Patent
Gillette

(10) Patent No.: US 10,724,815 B2
(45) **Date of Patent: *Jul. 28, 2020**

(54) TRIGGER ASSEMBLY

(71) Applicant: VARANGIAN INVESTMENTS, LLC, Midway, UT (US)

(72) Inventor: Miles Lewis Gillette, Logan, UT (US)

(73) Assignee: VARANGIAN INVESTMENTS, LLC, Midway, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/469,753

(22) PCT Filed: Jan. 26, 2018

(86) PCT No.: PCT/US2018/015433

§ 371 (c)(1),
(2) Date: Jun. 14, 2019

(87) PCT Pub. No.: WO2018/144338

PCT Pub. Date: Aug. 9, 2018

(65) Prior Publication Data

US 2019/0353443 A1 Nov. 21, 2019

Related U.S. Application Data

(63) Continuation-in-part of application No. 15/424,436, filed on Feb. 3, 2017, now Pat. No. 10,222,160.

(51) Int. Cl.
*F41A 9/10* (2006.01)
*F41A 19/12* (2006.01)
(Continued)

(52) U.S. Cl.
CPC ..... *F41A 19/10* (2013.01); *F41A 19/12* (2013.01); *F41A 19/14* (2013.01)

(58) Field of Classification Search
CPC ..... F41A 19/10; F41A 19/12; F41A 19/14
See application file for complete search history.

(56) References Cited

U.S. PATENT DOCUMENTS 2,462,585 A 2/1949 Wesson
2,765,561 A 10/1956 Morris
(Continued)

FOREIGN PATENT DOCUMENTS

DE 1904675 A1 8/1970
DE 9106615 U1 8/1991
(Continued)

OTHER PUBLICATIONS

Machine translation of DE-102009029951-A1 (Year: 2010).*
(Continued)

*Primary Examiner* — Joshua T Semick
(74) *Attorney, Agent, or Firm* — Dorsey & Whitney LLP

(57) ABSTRACT

A trigger assembly apparatus includes spherical portion(s) and spherical bearing(s), rounded sear, stabilizing catch, and complimentary shield. In an exemplary embodiment, the spherical portion(s) and spherical bearing(s) respond to non-linear movement. Further, the interaction of the spherical portion(s) and spherical bearing(s) results in the mobility of the trigger in relation to the 6 degrees of freedom thereby resulting in the firearm being generally unaffected by side to side movement of the trigger during activation. The trigger assembly may also include but is not limited to a rounded sear, stabilizing catch, and complimentary shield. The rounded portion of the sear engages the hammer stop notch at a single point further resulting in the firearm being generally unaffected by side to side movement of the trigger. Additionally the stabilizing catch and shield helps facilitate the proper reset of the trigger assembly.

25 Claims, 6 Drawing Sheets

(51) Int. Cl.
*F41A 19/14* (2006.01)
*F41A 19/10* (2006.01)

(56) References Cited

U.S. PATENT DOCUMENTS 4,392,319 A 7/1983 Ottolini
4,581,835 A 4/1986 Brouthers et al.
4,648,190 A 3/1987 Allen
5,635,664 A * 6/1997 Pons ..... F41A 19/44 42/69.03
6,460,281 B1 10/2002 Schaeffer
6,640,479 B2 11/2003 Gühring et al.
6,651,542 B2 11/2003 Danner et al.
6,769,208 B2 8/2004 Beretta
6,976,416 B2 12/2005 Ealovega
6,978,568 B2 12/2005 Jewell
7,010,879 B2 3/2006 Olson
7,051,638 B2 5/2006 Thomele
7,076,902 B2 7/2006 Hengstenberg et al.
7,156,662 B2 * 1/2007 Goko ..... F41A 19/16 362/111
7,162,824 B1 1/2007 McCormick
7,257,918 B2 8/2007 Moore
7,263,796 B2 9/2007 Kellermann et al.
7,293,385 B2 11/2007 McCormick
7,331,136 B2 2/2008 Geissele
7,600,338 B2 10/2009 Geissele
7,743,543 B2 6/2010 Karagias
7,992,335 B2 8/2011 Gangl
8,069,602 B2 12/2011 Geissele
8,074,393 B2 12/2011 Geissele
8,099,895 B2 1/2012 Farley, Jr. et al.
8,109,025 B2 2/2012 Stone
8,117,779 B2 2/2012 Doll et al.
8,122,634 B2 2/2012 Constant et al.
8,176,836 B2 5/2012 Peev
8,225,705 B2 7/2012 Dubois et al.
8,250,799 B2 8/2012 Duperry et al.
8,281,704 B2 10/2012 Kerbrat et al.
8,312,658 B2 11/2012 Lippard
8,359,778 B2 1/2013 Doll et al.
8,468,732 B2 6/2013 Young
8,490,309 B2 7/2013 Zukowski
8,510,980 B2 8/2013 Lee
8,522,466 B2 9/2013 Arduini
8,528,241 B2 9/2013 Pichler
8,572,880 B2 11/2013 Bender
8,756,843 B1 6/2014 Cantrell
8,850,734 B2 10/2014 Lupher et al.
8,857,090 B2 10/2014 Aigner
8,863,425 B2 10/2014 Lee
8,875,432 B2 11/2014 Goddard
8,893,607 B2 11/2014 Audibert et al.
8,904,690 B1 12/2014 Cantrell
8,985,006 B1 3/2015 Christensen et al.
8,985,007 B2 3/2015 Larson, Jr. et al.
9,046,313 B1 6/2015 Lutton et al.
9,052,150 B2 6/2015 Talasco
9,068,792 B2 6/2015 Macy
9,097,485 B2 8/2015 Lipowski
9,121,654 B2 9/2015 Arnedo Vera et al.
9,146,067 B2 9/2015 Stakes
9,163,890 B2 10/2015 Heizer
9,170,063 B2 10/2015 Krieger
9,175,916 B2 11/2015 Tasyagan
9,175,917 B2 11/2015 Bender
9,267,751 B2 2/2016 Ruiz
9,310,150 B1 * 4/2016 Geissele ..... F41A 19/16
9,347,725 B2 5/2016 McAlister
9,389,037 B2 7/2016 Reynolds
9,404,701 B2 8/2016 Lipowski
9,410,760 B2 8/2016 Siddle
9,541,341 B2 1/2017 MacY
9,562,731 B2 2/2017 Geissele
9,573,268 B2 2/2017 Azhocar
9,599,420 B2 3/2017 Moretti
9,612,072 B2 4/2017 Hochstrate et al.
9,612,073 B2 4/2017 Parajon
9,618,288 B2 4/2017 Wilson
9,618,289 B1 4/2017 Geissele
9,625,227 B2 4/2017 Lee
9,631,886 B2 4/2017 Findlay
9,638,485 B2 5/2017 Geissele
9,644,913 B2 5/2017 Dextraze
9,658,014 B2 5/2017 Anglisani
9,671,187 B2 6/2017 Colman
9,677,836 B2 6/2017 Lee
9,683,800 B2 6/2017 Sewell, Jr. et al.
9,714,804 B2 7/2017 Singh
9,718,182 B2 8/2017 Azhocar
9,739,557 B2 8/2017 Lee
9,746,271 B2 8/2017 Hughes et al.
9,752,841 B2 9/2017 Lipowski
9,759,504 B2 9/2017 Geissele
9,803,945 B2 10/2017 Audibert et al.
9,816,771 B2 11/2017 Ghitti
9,823,032 B2 11/2017 Allan
9,835,398 B2 12/2017 Biegel
9,863,730 B2 * 1/2018 Elftmann ..... F41A 19/15
9,927,197 B1 * 3/2018 Geissele ..... F41A 19/10
9,927,200 B2 3/2018 Kuracina
2001/0042332 A1 11/2001 Gering et al.
2003/0172571 A1 9/2003 West
2006/0101695 A1 5/2006 Longueira
2007/0051236 A1 3/2007 Groves et al.
2008/0060245 A1 3/2008 McCormick
2009/0158634 A1 6/2009 Bubits
2009/0188145 A1 7/2009 Fluhr et al.
2010/0281739 A1 11/2010 Geissele
2011/0030261 A1 2/2011 Karagias
2011/0067283 A1 3/2011 Baker
2011/0167691 A1 7/2011 Bowman et al.
2011/0185615 A1 8/2011 Gangl
2013/0104435 A1 5/2013 Fuller
2013/0174459 A1 7/2013 Moretti
2013/0269233 A1 10/2013 Chin
2014/0311006 A1 10/2014 Kott
2014/0311007 A1 10/2014 Capps et al.
2015/0020426 A1 1/2015 Neergaard
2016/0018176 A1 1/2016 Fellows et al.
2016/0040948 A1 2/2016 Barrett et al.
2016/0061549 A1 3/2016 Patterson et al.
2016/0131448 A1 5/2016 Bender
2016/0187092 A1 6/2016 Mather et al.
2016/0327357 A1 11/2016 Wheatley
2016/0356568 A1 12/2016 Kuracina
2016/0363401 A1 12/2016 Elftmann
2016/0370140 A1 12/2016 Geissele
2017/0003090 A1 1/2017 Kokinis et al.
2017/0045318 A1 2/2017 Verney-Carron
2017/0059267 A1 3/2017 Hudson et al.
2017/0067715 A1 3/2017 Conant et al.
2017/0097204 A1 4/2017 Geissele
2017/0102200 A1 4/2017 Alicea, Jr.
2017/0122686 A1 5/2017 Fellows et al.
2017/0131058 A1 5/2017 McPherson et al.

FOREIGN PATENT DOCUMENTS

DE 102009029951 A1 * 12/2010 ..... F41A 19/10
DE 102009029951 A1 12/2010
DE 102016109695 A1 11/2017
GB 263621 A 1/1927
WO 2015106759 A1 7/2015
WO WO-2015106759 A1 * 7/2015 ..... F41A 19/12

OTHER PUBLICATIONS

"15 minute trigger job?", http://www.predatornnastersforums.com/forums/ubbthreads.php?ubb=showflat&Number=1555088, post by user Juice1050, pp. 2-5 (Year: 2010).*
International Search Report and Written Opinion for International Application No. PCT/US2018/015433 dated Mar. 16, 2018.

(56) References Cited

OTHER PUBLICATIONS

Issue Notification for U.S. Appl. No. 15/424,436 dated Feb. 13, 2019.
Non-Final Office Action for U.S. Appl. No. 15/424,436 dated Feb. 2, 2018.
Notice of Allowance for U.S. Appl. No. 15/424,436, dated Nov. 1, 2018.
Notice of Allowance for U.S. Appl. No. 15/424,436 dated Jul. 10, 2018.
Restriction Requirement for U.S. Appl. No. 15/424,436 dated Oct. 5, 2017.
U.S. Appl. No. 15/424,436, filed Feb. 3, 2017.

* cited by examiner

TRIGGER ASSEMBLY

CROSS-REFERENCE TO RELATED APPLICATIONS

This application claims priority to U.S. patent application Ser. No. 15/424,436 filed on Feb. 3, 2017, the disclosure of which is incorporated herein in its entirety by this reference.

BACKGROUND

Firearms and instruments with similar functions typically employ a traditional trigger assembly apparatus mechanism. Traditional trigger assemblies are configured to activate in response to linear motion. A standard traditional trigger assembly, for example, responds to pressure exerted linearly. A standard traditional trigger assembly includes a sear. The sear functions to hold the hammer, striker or other equivalent portion of the firearm in place until the user activates the trigger by applying pressure. When the pressure on a standard traditional trigger reaches a predetermined level, the sear releases allowing the hammer, striker or other equivalent portion of the firearm to engage resulting in discharging the firearm. Often the pressure exerted on the trigger by the user will include a non-linear motion portion. Numerous users find that this non-linear pressure causes the firearm to pull to one side resulting in less accuracy, commonly referred to as trigger pull. Many users employ various mitigating techniques to attempt to improve accuracy and compensate for trigger pull. Further, users engaged in competitions or other activities requiring accuracy devote substantial time and effort to various mitigating techniques.

SUMMARY

An embodiment of a trigger assembly is disclosed. The trigger assembly includes a trigger, a hammer including a stop notch, a sear adapted to engage the stop notch to hold the hammer in a cocked position, and a disconnector that rotates around a disconnector pin and a spherical portion engaging the disconnector pin. The trigger assembly includes a spherical bearing engaging the spherical portion, wherein the spherical bearing is adapted to move about the spherical portion thereby responding to pressure on the trigger in all six degrees of freedom such that, upon activation, the sear disengages from the stop notch.

Another embodiment of trigger assembly is disclosed. The trigger assembly includes a trigger, a hammer; a sear including a rounded end adapted to engage and hold the hammer in a cocked position, and a ball joint operably coupled to the trigger and configured to respond to pressure on the trigger in all six degrees of freedom such that, upon activation, the sear disengages from the hammer.

Yet another embodiment of trigger assembly is disclosed. The trigger assembly includes a trigger and one or more ball joints that engage the trigger. Each of the one or more ball joints includes a spherical bearing element and a bearing seat that receives the spherical bearing element, wherein the one or more ball joints are configured to enable the trigger to move in six degrees of freedom such that the trigger is configured to be activated through force applied to the trigger in any of the six degrees of freedom.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The accompanying drawings illustrate various examples of the exemplary embodiments described herein and are a part of the specification. The illustrated exemplary embodiments are merely examples and do not limit the scope of the claims:

Throughout the drawings, identical reference numbers designate similar, but not necessarily identical, elements.

DETAILED DESCRIPTION

Throughout this description and in the accompanying drawings reference is made to principles of the invention through the use of exemplary embodiments. It should be understood that the application is not limited to the details or specific methodologies set forth herein. It should also be understood that the terminology used herein is for the purpose of description only and should not be regarded as limiting.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an example" or similar language means that a particular feature, structure, or characteristic described in connection with the example is included in at least that one example, but not necessarily in other examples.

Figure 1:
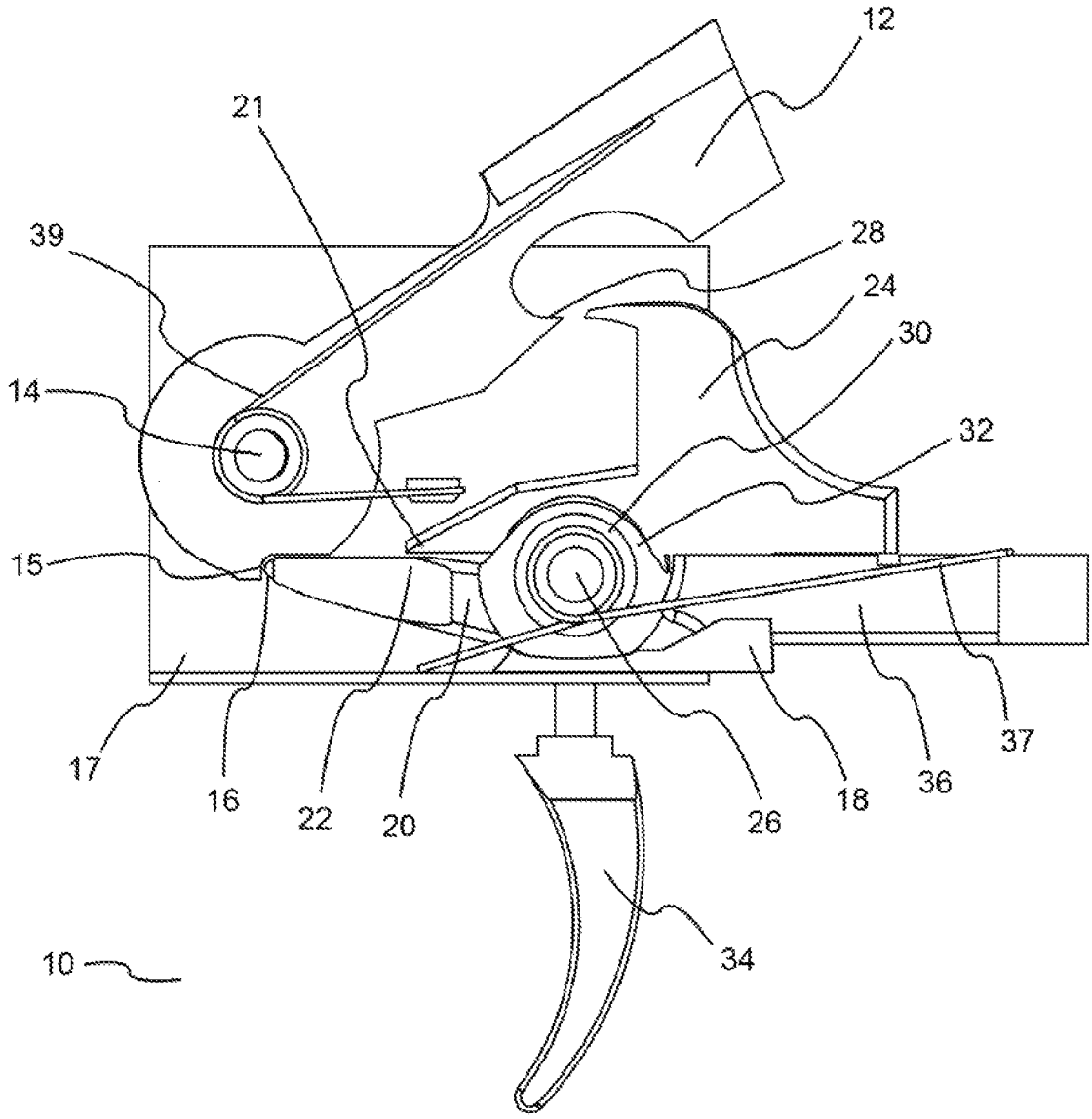
FIG. 1 is a cut-away view of a trigger assembly apparatus that includes a spherical portion according to an exemplary embodiment described herein.
Figure 2:
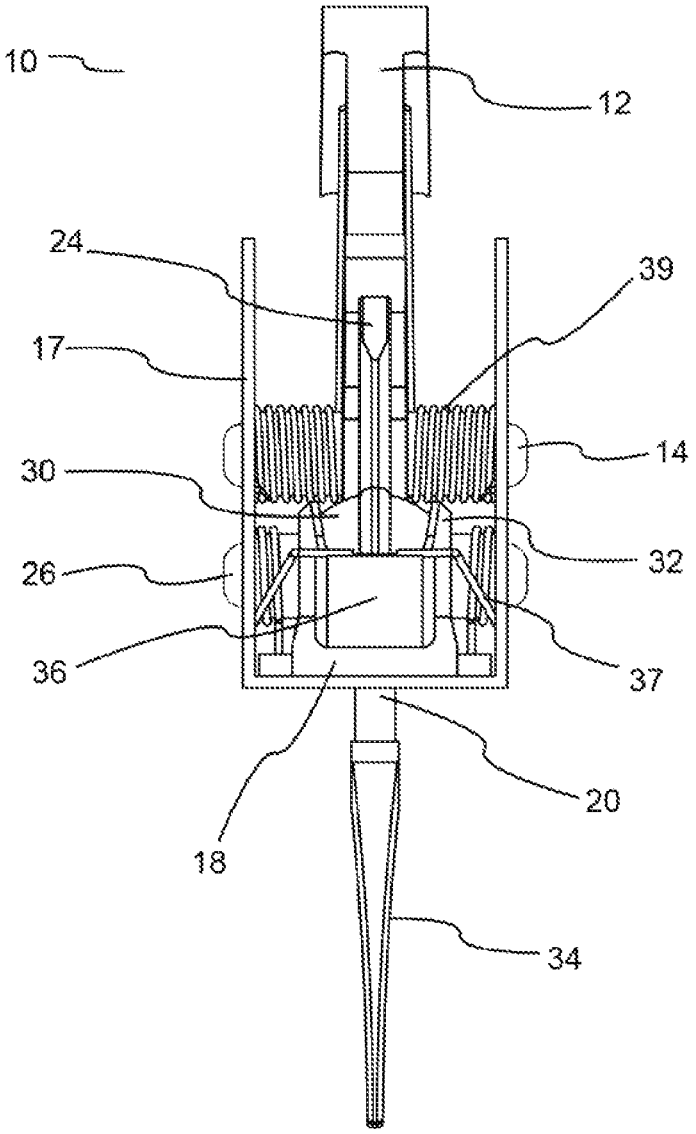
FIG. 2 is a rear view of a trigger assembly apparatus of a like embodiment as illustrated in FIG. 1 according to an exemplary embodiment described herein.
Figure 3:
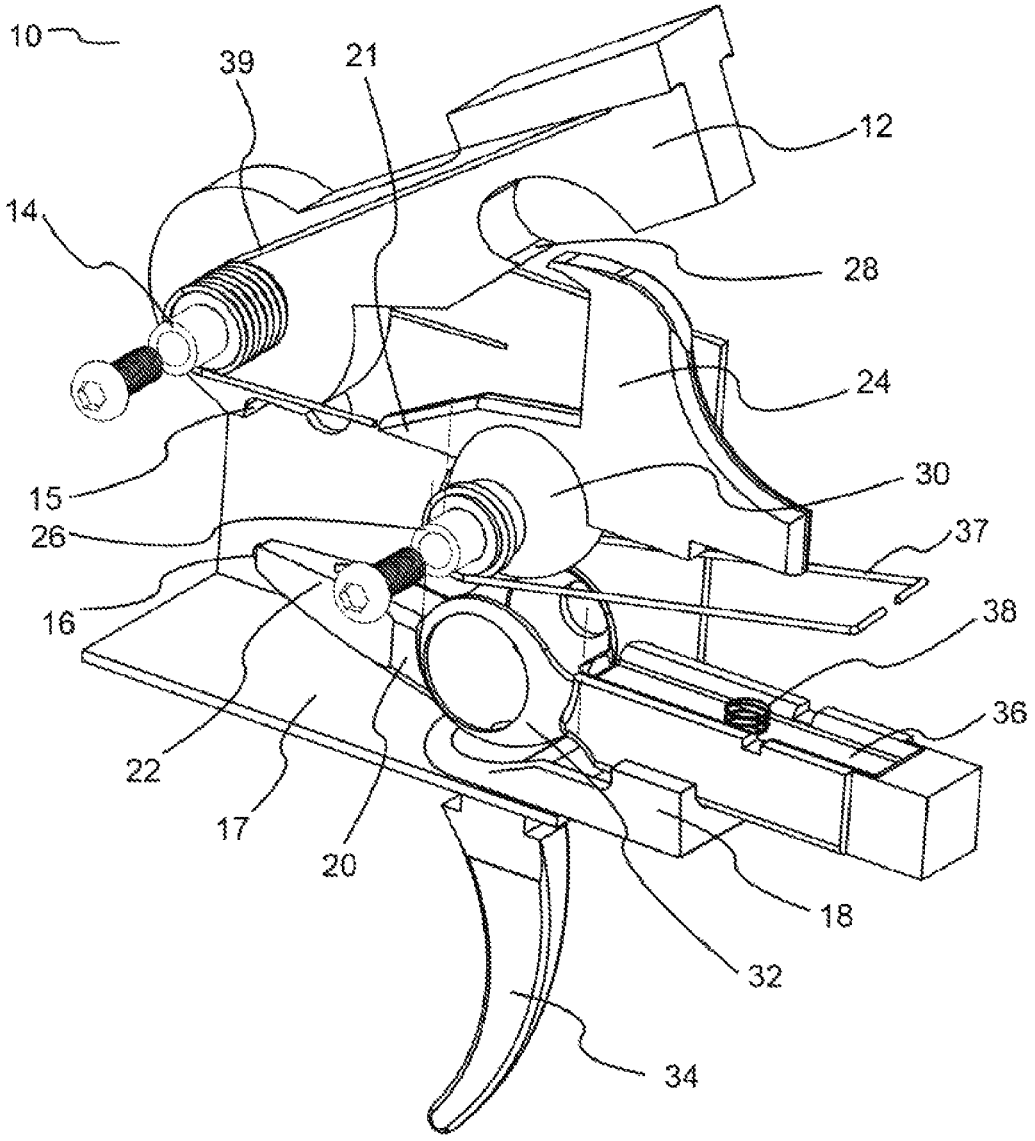
FIG. 3 is a perspective exploded view of a trigger assembly apparatus of a like embodiment as illustrated in FIG. 1 according to an exemplary embodiment described herein.

Referring initially to FIGS. 1 through 3, an exemplary embodiment of the overall trigger assembly apparatus 10 taught by the invention provides a hammer 12 which rotates around a hammer pin 14. A hammer spring 39 provides constant tension on hammer 12. Hammer 12 incorporates a stop notch 15 into which sear 16 fits. Sear 16 is a rounded tip on the anterior of trigger element 20 that engages with hammer 12 at hammer stop notch 15.

In this exemplary embodiment, the trigger assembly apparatus 10, as designed for rifle platforms such as the Armalite platform but adaptable for use on other firearm platforms, also includes disconnector 24 that rotates around disconnector pin 26. If hammer 12 is drawn back far enough in the act of resetting or cocking, disconnector 24 is able to engage a catch nose 28 on hammer 12. This style of trigger assembly apparatus may be used on rifle platforms such as the Armalite platform but Disconnector 24 incorporates an anterior portion 21 and a spherical portion 30 generally centered on the axis of disconnector pin 26.

Trigger element 20 incorporates an anterior portion 22, sear 16, trough 36, trigger 34 and a spherical bearing 32. Spherical bearing 32 engages spherical portion 30 thereby enabling any combination of the 6 degrees of motion from pressure on trigger 34. Sear 16 is rounded to allow freedom of movement within hammer stop notch 15. As trigger element 20 moves about spherical portion 30, sear 16 reduces any adverse pressure against hammer 12 and against the firearm. Sear 16 is positioned so that when trigger 34 is pulled backward, trigger element 20 rotates and sear 16 disengages from hammer stop notch 15.

Trigger spring 37 engages trigger element 20 and provides the force necessary to keep trigger element 20 in a resting position. In this position, trigger element 20 engages stabilizing catch 18 so that trigger 36 is held in a generally vertical orientation. Once trigger 34 is pulled backward, trigger element 20 disengages from stabilizing catch 18, allowing trigger element 20 to rotate freely.

Trough 36 of trigger element 20 receives the posterior of disconnector 24. Trough spring 38 is located within trough 36 and applies force to disconnector 24 so that it favors engagement with catch nose 28 on hammer 12 after hammer 12 has been released and is forced back to be reset as part of the firing cycle. However, anterior portion of disconnector 21 is spaced appropriately from the anterior of trigger element 22 such that when trigger 34 is released by the operator, the torque applied to trigger element 20 by trigger spring 37 causes trigger 34 to move into a forward motion. This motion forces the anterior of trigger element 22 upward against anterior portion of disconnector 21, causing disconnector 24 to rotate backward about disconnector pin 26. This rotation forces disconnector 24 backwards with a downward force against trough spring 38, thereby allowing disconnector 24 to dip into trough 36 and disengage from catch nose 28 on hammer 12 at a time when trigger element 20 is in the proper reset position with sear 16 fitting back into hammer stop notch 15.

When trigger 34 is pulled backward, trigger element 20 rotates with any combination of the 6 degrees of freedom about spherical bearing 30. This freedom of motion for trigger element 20 changes the angle of contact between sear 16 and hammer stop notch 15. The rounded design of sear 16 allows it to rotate within hammer stop notch 15 preventing adverse pressure on hammer 12 as sear 16 disengages from hammer stop notch 15 with backward motion of trigger element 20. The backward motion of trigger element 20 caused by the user's pressure on trigger 34, forces trough 36 in an upward motion. Trough spring 38 transfers the forward motion of trough 36 to disconnector 24. This causes disconnector 24 to rotate forward about disconnector pin 26. Disconnector 24 is spaced from hammer 12 as to allow disconnector 24 to rotate forward without initially engaging catch nose 28 on hammer 12.

Pulling trigger 34 farther backward continues the downward motion on the anterior of trigger element 22. Sear 16, located on the anterior of trigger element 22, then disengages with hammer 12 at hammer stop notch 15. As sear 16 disengages from hammer stop notch 15, hammer 12 is forced to rotate forward about hammer pin 14 due to the tension of hammer spring 39. This release of hammer 12 allows it to strike firing pin (not shown). After the round (not shown) has been fired, hammer 12 is driven back from the force of the discharge as the bolt carrier assembly in the upper receiver (not shown) is driven rearward to cycle the firearm.

Upon discharge of the firearm in selected semi-automatic fire, hammer 12 is driven back far enough that disconnector 24 engages catch nose 28 and prevents hammer 12 from rotating and hitting the firing pin (not shown) a second time. When trigger 34 is eventually released, trigger element 20 is forced back into its resting position by trigger spring 37 with sear 16 in position ready to connect with hammer stop notch 15. This resetting motion of trigger element 20 results in the anterior of trigger element 22 making contact with the anterior portion of disconnector 21, forcing disconnector 24 to rotate backwards. This backward motion of disconnector 24 is just enough to disengage disconnector 24 from catch nose 28. This results in hammer 12 rotating forward slightly until hammer stop notch 15 engages sear 16. The trigger assembly is then completely reset and ready to be cycled again.

Because spherical bearing 32 of trigger element 20 bears around spherical portion 30 of disconnector 24, trigger element 20 has the ability to move in any combination of the 6 degrees of motion such as up/down, left/right, forward/backward as well as rotation about perpendicular axes commonly known as pitch, yaw and roll.

This result of this configuration is that when the firearm is fired, side-to-side forces on trigger 34 are reduced, and consequently do not have the same effect on the firearm as a traditional trigger confined to linear motion. Rounding the end of sear 16 so it engages hammer stop notch 15 at a single point allows the trigger assembly apparatus 10 to be generally immune to adverse effects of side-to-side forces. Thus, if trigger 34 moves side-to-side, sear 16 simply rotates within hammer stop notch 15 maintaining about the single point of contact where sear 16 engages hammer stop notch 15 without danger of it disengaging from notch 15. The trigger assembly apparatus 10 is held together as one unit with case 17, creating a self-contained trigger system and thereby providing structure and stability to the trigger apparatus while allowing trigger 34 to move appropriately.

Figure 4:
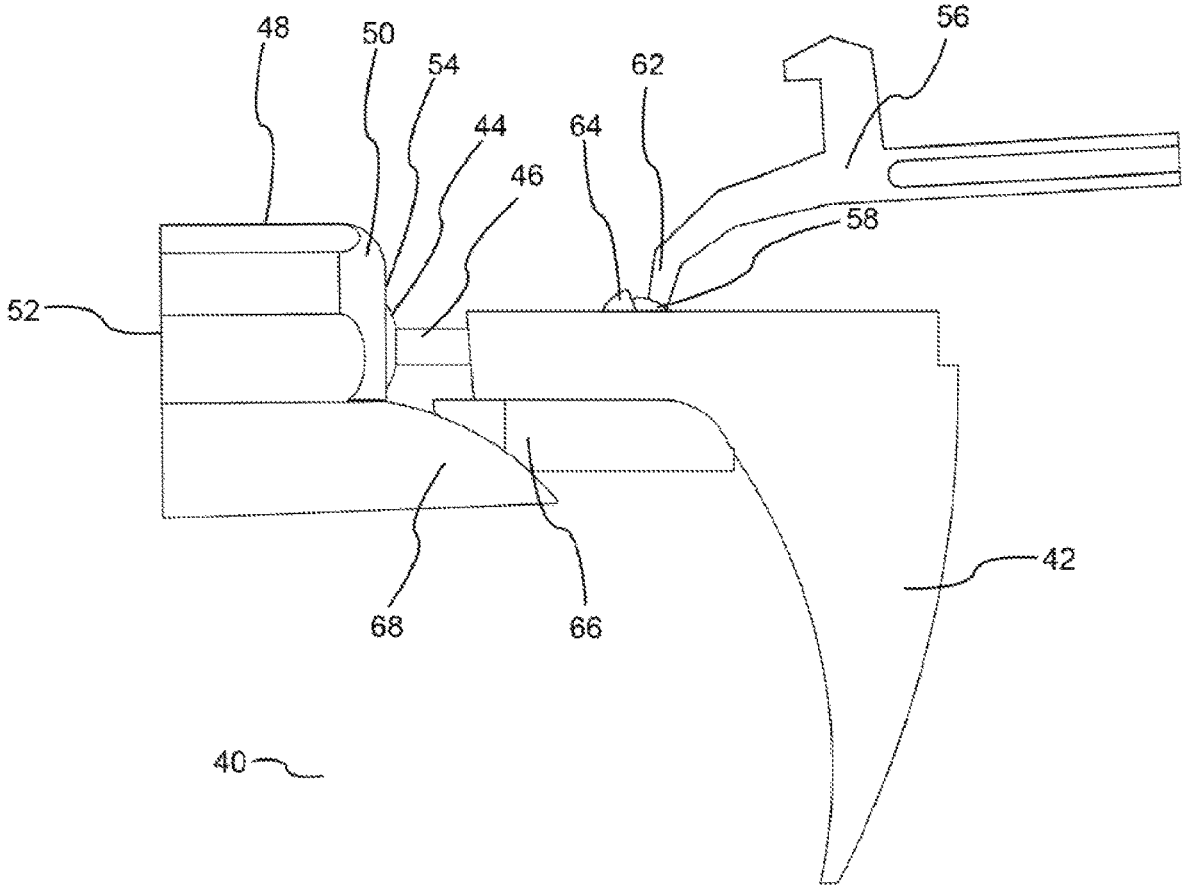
FIG. 4 is a side view of a trigger assembly apparatus that includes a spherical portion according to an additional exemplary embodiment described herein.
Figure 5:
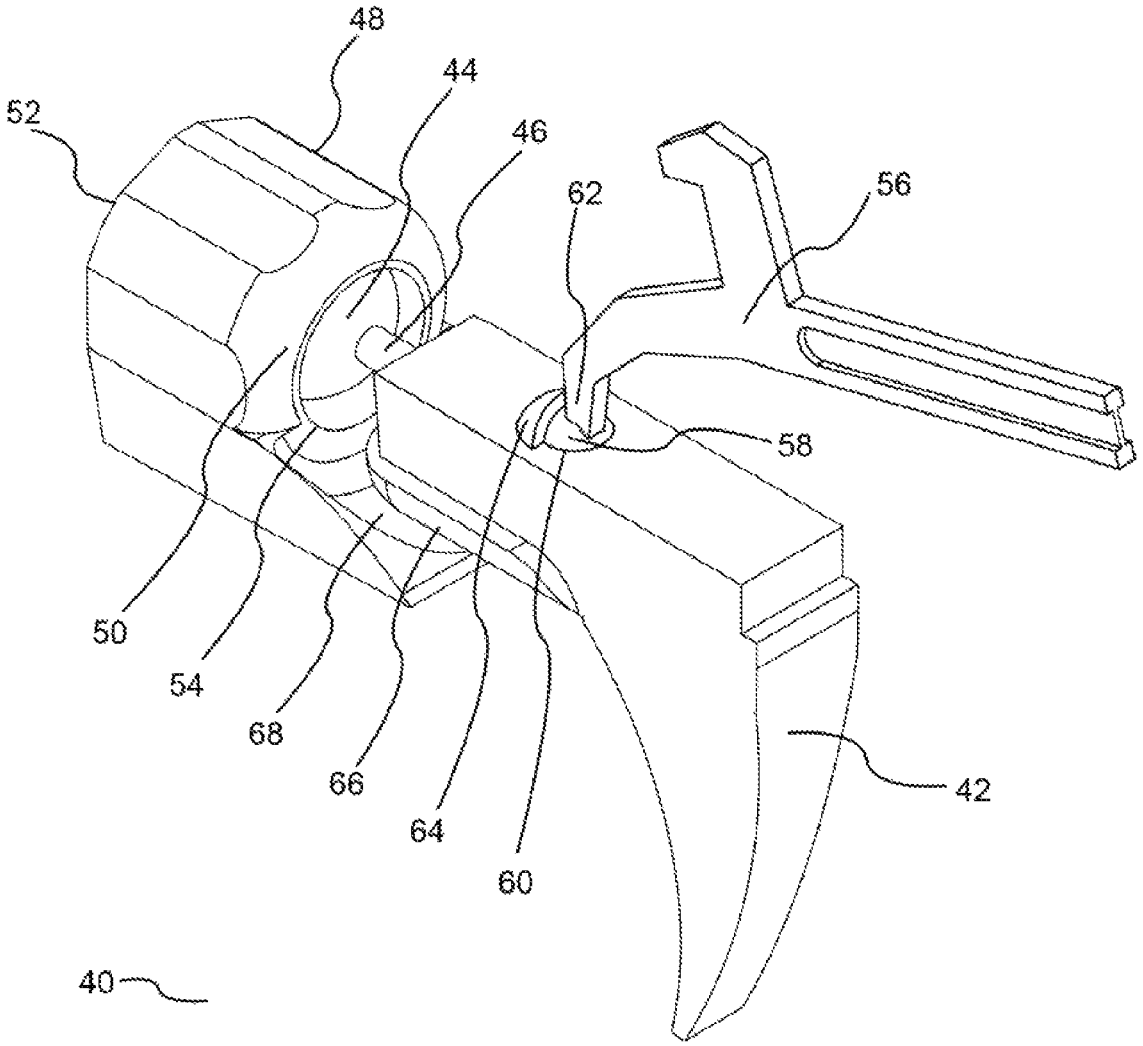
FIG. 5 is a perspective view of a trigger assembly apparatus of a like embodiment as illustrated in FIG. 4 according to an exemplary embodiment described herein.
Figure 6:
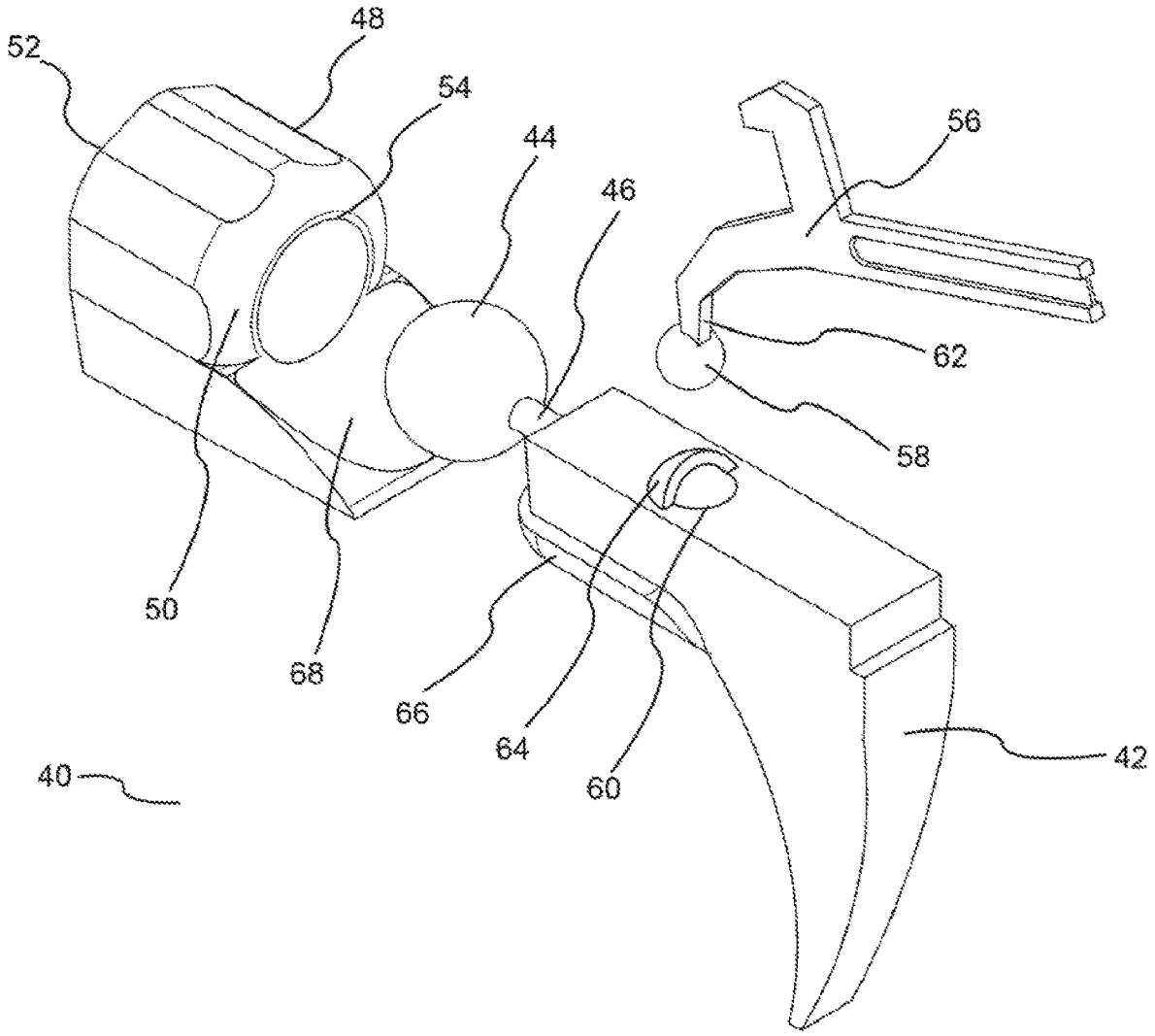
FIG. 6 is a perspective exploded view of a trigger assembly apparatus of a like embodiment as illustrated in FIG. 4 according to an exemplary embodiment described herein.

Referring to FIGS. 4 through 6, an additional exemplary embodiment of the invention, trigger assembly apparatus 40, is shown. In this embodiment, trigger 42 is connected to a first spherical portion 44 by connecting portion 46. First spherical portion 44 mates with first spherical bearing 48 providing a ball joint. First spherical bearing 48 includes posterior side 50 and anterior side 52. First spherical bearing 48 is affixed to the firearm. As shown, first spherical bearing 48 is oriented so that opening 54, that accepts first spherical portion 44 is on the posterior side 50 of first spherical bearing 48, but it will be understood that any orientation could be used.

Connecting portion 46 substantially rigidly attaches first spherical portion 44 to trigger 42. Connecting portion 46 attaches first spherical portion 44 such that trigger 42 does not interfere with first spherical bearing 48. Thus, the substantially rigid connection of first spherical portion 44 to trigger 42 by connecting portion 46 allows trigger 42 rotate in substantially all degrees of rotational freedom.

Trigger 42 contains a substantially hemispherical second spherical bearing 60 that mates with a second spherical portion 58. Connecting bar 62 substantially rigidly attaches second spherical portion 58 to trigger bar 56. Shield 64 is a protruding extension of second spherical bearing 60 that is attached to trigger 42 and serves both to capture second spherical portion 58 and to allow proper reset of connecting bar 62 when sliding forward. Trigger bar 56 connects to the trigger mechanism housing with ejector (not shown) such that upward and rearward movement of trigger bar 56 initiates the firing process. This configuration allows rearward motion of trigger 42 to translate into upward and rearward movement of trigger bar 56, while rotation of trigger 42 about any other axis has no appreciable effect.

When trigger 42 is in its resting position, rounded bottom front portion 66 of trigger 42 mates with stabilizing catch 68. Stabilizing catch 68 is attached to first spherical bearing 48. The rounded bottom front portion 66 and stabilizing catch 68 are kept tightly seated by the forward and downward force of trigger bar 56 upon trigger 42.

When trigger 42 is pulled backward, rounded bottom front portion 66 disengages from stabilizing catch 68, allowing trigger 42 to rotate freely about first spherical portion 44. This isolates the firearm both from side-to-side forces and from torques about axis A-A. A-A is the axis formed by the centers of first spherical portion 44 and second spherical portion 58. In contrast, backward motion of trigger 42 is translated to trigger bar 56 independent of orientation. Thus, when the firearm is fired, side-to-side forces and torques on trigger 42 will not adversely affect the operator's aim.

The preceding description has been presented only to illustrate and describe examples of the principles described. This description is not intended to be exhaustive or to limit these principles to any precise form disclosed. Many modifications and variations are possible in light of the above teaching.

What is claimed is:

1. A trigger assembly, comprising:

a trigger;

a hammer including a stop notch;

a sear adapted to engage the stop notch to hold the hammer in a cocked position;

a disconnector that rotates around a disconnector pin and a spherical portion engaging the disconnector pin; and a spherical bearing operably coupled to the sear via a trigger element, the spherical bearing engaging the spherical portion;

wherein the spherical bearing is adapted to move about the spherical portion thereby responding to pressure on the trigger in all six degrees of freedom such that, upon activation, the sear disengages from the stop notch.

2. The trigger assembly according to claim 1, wherein the sear includes a rounded portion located thereon in a position to engage the stop notch.

3. The trigger assembly according to claim 2, further comprising a trigger spring engaging the trigger element, wherein the trigger spring provides force on the trigger element to engage the rounded portion of the sear, thereby allowing the trigger to be generally unaffected by side to side movement.

4. The trigger assembly according to claim 1, where in the hammer further comprises a catch nose configured to engage the disconnector after the trigger is activated, thereby preventing reactivation of the trigger without resetting the trigger.

5. A trigger assembly, comprising:

a trigger;

a hammer;

a sear including a rounded end adapted to engage and hold the hammer in a cocked position; and a ball joint operably coupled to the trigger and the sear, wherein the ball joint is configured to respond to pressure on the trigger in all six degrees of freedom such that, upon activation, the sear disengages from the hammer.

6. The trigger assembly of claim 5, further:

a trigger element extending between the sear and the ball joint; and a trigger spring engaging the trigger element, wherein the trigger spring provides force on the trigger element to engage the rounded end of the sear against a stop notch of the hammer.

7. The trigger assembly of claim 5, wherein the ball joint includes a spherical bearing element and a bearing seat configured to receive the spherical bearing element and move about the spherical bearing element.

8. The trigger assembly of claim 7, further comprising:

a disconnector that is rotatable about a disconnector pin, wherein the disconnector pin engages the spherical bearing element; and wherein the hammer includes a catch nose configured to engage the disconnector after the trigger is activated to thereby prevent reactivation of the trigger without resetting the trigger.

9. The trigger assembly of claim 7, wherein the spherical bearing element of the ball joint connects to the trigger and bears on the bearing seat.

10. The trigger assembly of claim 7, wherein the bearing seat of the ball joint connects to the trigger and bears on the spherical bearing element.

11. The trigger assembly of claim 5, wherein the hammer includes a stop notch, and the rounded end of the sear is sized and positioned to fit in the stop notch to engage and hold the hammer in a cocked position.

12. A trigger assembly, comprising:

a trigger; and one or more ball joints that engage the trigger, each of the one or more ball joints including:

a spherical bearing element; and a bearing seat that receives the spherical bearing element;

wherein the one or more ball joints are configured to enable the trigger to move in six degrees of freedom such that the trigger is configured to be activated through force applied to the trigger in any of the six degrees of freedom.

13. The trigger assembly of claim 12, wherein a first spherical bearing element of the one or more ball joints is sized and shaped to fit in and move with respect to a first bearing seat.

14. The trigger assembly of claim 12, wherein a first spherical bearing element of the one or more ball joints is operably coupled to the trigger and bears against a first bearing seat.

15. The trigger assembly of claim 12, wherein a first bearing seat of the one or more ball joints connects to the trigger and bears against a first spherical bearing element.

16. The trigger assembly of claim 12, further comprising:

a hammer; and a sear operably coupled to the trigger, the sear having a rounded end adapted to engage and hold a hammer in a cocked position.

17. The trigger assembly of claim 16, wherein the trigger is operably coupled to a trigger element and the sear forms an anterior portion of the trigger element.

18. The trigger assembly of claim 16, further comprising at least one spring sized and positioned to bias the sear against a stop notch on the hammer.

19. The trigger assembly of claim 16, further comprising a trigger bar operably coupled to one of the one or more ball joints.

20. The trigger assembly of claim 19, wherein the one or more ball joints, include:

a first ball joint having a first spherical portion engaging the trigger that is configured to allow the trigger to move in all six degrees of freedom; and a second ball joint having a second spherical portion engaging the trigger bar that is configured to allow upward and rearward motion of the trigger bar.

21. The trigger assembly of claim 20, further comprising a first spherical bearing engaging the first spherical portion.

22. The trigger assembly of claim 21, further comprising a stabilizing catch configured to connect to the first spherical bearing such that forward and downward force on the trigger bar maintains the stabilizing catch tightly seated against the trigger.

23. The trigger assembly of claim 20, further comprising a second spherical bearing engaging the second spherical portion.

24. The trigger assembly of claim 23, wherein the second spherical bearing is substantially hemispherical.

25. The trigger assembly of claim 20, further comprising a connecting bar connecting the second spherical portion to the trigger bar.

* * * * *